US007453049B2

(12) United States Patent
Ochiai et al.

(10) Patent No.: US 7,453,049 B2
(45) Date of Patent: Nov. 18, 2008

(54) SNAP ACTION MECHANISM AND PRESSURE SWITCH USING SNAP ACTION MECHANISM

(75) Inventors: Koichi Ochiai, Chiyoda-ku (JP); Takashi Tsumura, Chiyoda-ku (JP); Kazuo Abe, Chiyoda-ku (JP); Isamu Warashina, Chiyoda-ku (JP)

(73) Assignee: Yamatake Corporation, Tokyo (JP)

( * ) Notice: Subject to any disclaimer, the term of this patent is extended or adjusted under 35 U.S.C. 154(b) by 0 days.

(21) Appl. No.: 11/884,844

(22) PCT Filed: Feb. 23, 2006

(86) PCT No.: PCT/JP2006/303317

§ 371 (c)(1),
(2), (4) Date: Aug. 22, 2007

(87) PCT Pub. No.: WO2006/090797

PCT Pub. Date: Aug. 31, 2006

(65) Prior Publication Data

US 2008/0164134 A1 Jul. 10, 2008

(30) Foreign Application Priority Data

Feb. 23, 2005 (WO) ..... PCT/JP2005/002920

(51) Int. Cl.
*H01H 35/24* (2006.01)

(52) U.S. Cl. ..... 200/83 A; 200/83 P; 200/83 S; 200/449; 200/451

(58) Field of Classification Search ..... 200/405, 200/440–443, 446, 449, 451–454, 456, 458–461, 200/83 R, 83 A, 83 J, 83 N, 83 P, 83 SA, 200/83 W, 83 S See application file for complete search history.

(56) References Cited

U.S. PATENT DOCUMENTS 3,984,649 A * 10/1976 Bauer et al. ..... 200/83 SA
4,052,574 A * 10/1977 Brown ..... 200/83 P
4,297,552 A * 10/1981 Lauritsen et al. ..... 200/83 P
4,671,116 A * 6/1987 Glennon et al. ..... 73/728
5,086,198 A * 2/1992 Arakawa ..... 200/456
5,187,338 A * 2/1993 Kaigler ..... 200/83 R
5,565,666 A * 10/1996 Kautz ..... 200/83 P (Continued)

FOREIGN PATENT DOCUMENTS

DE 1 640 613 A 10/1970

(Continued)

*Primary Examiner*—Michael A Friedhofer
(74) *Attorney, Agent, or Firm*—Sughrue Mion, PLLC

(57) ABSTRACT

A pressure switch includes an external force transmission mechanism for separating a cover from a housing. The cover and the external force transmission mechanism defines a first pressure chamber, and the housing and the external force transmission mechanism defines a second pressure chamber. In the second pressure chamber, a movable piece having first and second movable members arranged opposite to each other and one or more fixed contacts are disposed. The first and second movable members are connected to each other via a flat spring. A contact is disposed on the second movable member and functions as a movable contact. The external force transmission mechanism applies an external force to the first movable member to displace the first movable member, and the second movable member is reversed at the operating point of the first movable member, so that the movable contact is brought into contact with the fixed contact.

6 Claims, 12 Drawing Sheets

U.S. PATENT DOCUMENTS 6,346,681 B1 * 2/2002 Joyce et al. ..... 200/83 S
7,071,430 B2 * 7/2006 Farano et al. ..... 200/81.4

FOREIGN PATENT DOCUMENTS

GB 722658 A 1/1955
JP 57-163638 10/1982
JP 63-13213 A 1/1988
JP 5-114341 A 5/1993

* cited by examiner (a)

(b)

( a )

( b )

(a)

(b)

SNAP ACTION MECHANISM AND PRESSURE SWITCH USING SNAP ACTION MECHANISM

FIELD OF THE INVENTION

The present invention relates to a snap action mechanism and a pressure switch.

BACKGROUND OF THE INVENTION

Pressure switches have conventionally been employed as safety apparatus for use in hot water supply equipment. Although a fan for exhaust air rotates when hot water supply equipment works, there is a possibility that incomplete combustion may be caused and carbon monoxide may be produced if the hot water supply equipment works with the fan not rotating. Therefore, in order to detect an air blast from the fan, wind pressure is transmitted as an external force and a pressure switch for performing a contact operation on contacts is used.

When one of two movable pieces receives the external force in a state in which the two movable pieces are connected to each other via a flat spring, the movable piece causes a continuous movement thereof according to the external force. At the moment when the movement of the movable piece which has received the external force reaches a certain position, the other movable piece causes a movement thereof quickly. The prior art pressure switch uses a method of performing a contact operation on the contacts using such a snap action mechanism (for example, refer to patent reference 1). That is, the snap action mechanism functions as a switch which is placed selectively in either of two positions according to the external force.

Hereafter, the prior art pressure switch disclosed in patent reference 1will be explained with reference to FIGS. 10 to 15. FIG. 10 is a diagram showing main constitution parts of the prior art pressure switch. FIG. 10(*a*) shows individual parts, and FIG. 10(*b*) shows a top plan view in a state where they are coupled to one another.

A movable piece 16 and a load adjustment plate 18 which are shown in FIG. 10(*a*) are fixed to each other with caulking at a joined part 18*a*. A hinge portion 17*c* of a movable piece 17 and the load adjustment plate 18 are fixed to each other with caulking at a joined part 18*b*. Furthermore, in the state of FIG. 10(*b*), the hinge portion 17*c* of the movable piece 17 is fixed to a base 15 made from a resin with caulking at a joined part 17*d* thereof (refer to FIG. 11). A flat spring 19 has engaging portions 19*a* at both ends thereof, the engaging portion at one end being engaged with an engaging portion 17*e* of the movable piece 17, and the engaging portion at the other end being engaged with an engaging portion 16*b* of the movable piece 16, and the flat spring 19 is shaped like a character C in a state in which openings are opposite to both the movable pieces 16 and 17, respectively.

FIG. 11 is a diagram showing the operation of the movable piece 16. FIG. 11(*a*) shows an initial state, and FIG. 11(*b*) shows a state in which a plunger 4*c* connected to a diaphragm with the wind pressure comes down so that the movable piece 16 is pressed downwardly. In order to make it easier to understand the operation of the movable piece 16, the flat spring 19 is omitted in the figure.

When the external force from the plunger 4*c* acts on the movable piece 16, an elastic deformation portion of the movable piece 16 curves and produces a reaction force, and the curving stops at a time when the reaction force has a balance with the external force. This elastic deformation portion serves as a supporting point.

FIG. 12 is a view showing the operation of the movable piece 17 of FIG. 10. Contacts 17*a* and 17*b* are attached to both sides of a leading end portion of the movable piece 17, respectively. In FIG. 12(*a*), the contact 17*b* is brought into contact with a lower contact 14*a*, and, In FIG. 12(*b*), the contact 17*a* is brought into contact with an upper contact 12*a*. In order to make it easier to understand the operation of the movable piece 17, the movable piece 16 and the flat spring 19 are omitted in the figures.

Although the movable piece 17 also causes an elastic deformation thereof, the movable piece 17 can be moved only between the upper and lower terminals 12*a* and 14*a*. This elastic deformation portion also serves as a supporting point, like that of the movable piece 16.

FIG. 13 is a diagram showing the operation of the prior art pressure switch. FIG. 13(*a*) shows either an initial state or a returned state, and FIG. 13(*b*) shows a state in which the movable pieces 16 and 17 are reversed because of the external force.

Because the leading end portions of the movable pieces 16 and 17 are connected to each other via the flat spring 19, a repulsive force (designated by an arrow of FIG. 13) acts between the both leading end portions. In FIG. 13(*a*), assuming that the leading end portion of the movable piece 16 is oriented upwardly, a repulsive force acts downwardly on the leading end portion of the movable piece 17. Therefore, the contact 17*b* disposed on the lower side of the leading end portion of the movable piece 17 is brought into contact with the lower contact 14*a*. On the other hand, the position of the movable piece 16 is restricted by the plunger 4*c*.

When the external force is exerted upon the movable piece 16 via the plunger 4*c* in the state of FIG. 13(*a*), the elastic deformation portion of the movable piece curves and the rigid body portion moves downwardly. When the rigid body portion of the movable piece 16 further moves with increase in the external force and then reaches a certain point, the moment which presses the contact 17*b* of the movable piece 17 toward the lower contact 14*a* is reversed. As a result, the movable piece 17 moves upwardly quickly and the contact 17*a* is brought into contact with the upper contact 12*a*. FIG. 13(*b*) shows this state and this series of operations are referred to as a reversing operation.

Next, when the external force is decreased gradually, the bending of the elastic deformation portion of the movable piece 16 decreases, and the rigid body portion of the movable piece 16 moves upwardly (i.e., it starts returning to its original position). When the rigid body portion of the movable piece then moves to a certain point, the moment which presses the contact 17*a* of the movable piece 17 toward the upper contact 12*a* is reversed. As a result, the movable piece 17 moves downwardly quickly and the contact 17*b* is brought into contact with the lower contact 14*a* again. Thus, the movable piece returns to its original state (i.e., a returned state) of FIG. 13(*a*), and this series of operations is referred to as a returning operation.

The switch mechanism using the above-mentioned reversing operation and returning operation is referred to as a snap action mechanism, the operation of the pressure switch is determined by the geometric positions of the movable pieces 16 and 17.

FIG. 14 is a diagram showing a load adjustment mechanism of the prior art pressure switch. FIG. 14(*a*) shows either an initial state or a returned state, and FIG. 14(*b*) shows a reversed state. FIG. 15 is a view showing deformation of the hinge portion of the movable piece 17.

The magnitude of the reaction force (load) of the movable piece 16 against the external force can be adjusted. In a case in which the elastic deformation portion of the movable piece 16 is beforehand bent by a certain degree, the reaction force of the movable piece 16 increases. Therefore, even if the movable piece 16 undergoes the same displacement, the above-mentioned reaction force has a balance with a larger external force than that in the case in which the elastic deformation portion is not bent at all in advance. By using this principle, the load which causes the switch to reverse can be adjusted to a desired value.

The load adjustment mechanism will be explained below. The hinge portion 17*c* of the movable piece 17 is joined to the base 15 at the joined part 17*d* thereof, as mentioned above (refer to FIG. 10(*b*)). As shown in FIG. 14, when a leading end portion 18*c* of the load adjustment plate 18 is pushed upwardly by a setscrew 20, the hinge portion 17*c* of the movable piece 17 becomes deformed with the joined part 17*d* serving as a supporting point, and the load adjustment plate 18 is lifted (refer to FIG. 15). Because the joined part 18*a* at which the load adjustment plate 18 is joined to the movable piece 16 drops simultaneously, bending occurs in the elastic deformation portion of the movable piece 16. Because the distance between the joined part 17*d* of the movable piece 17 and the leading end portion 18*c* of the load adjustment plate 18 which is pushed up by the setscrew 20 is short, the hinge portion 17*c* of the movable piece 17 becomes deformed to have an acute angle until its deformation reaches a plastic zone through an elastic zone, and therefore plastic deformation occurs in the vicinity of the joined part 17*d* of the hinge portion 17*c*. Therefore, after that, when the setscrew 20 is loosened, the hinge portion 17*c* does not return to its initial position. More specifically, the load adjustable range becomes narrow. Although this problem can be solved by lengthening the distance between the joined part 17*d* of the movable piece 17 and the leading end portion 18*c* of the load adjustment plate 18, there arises another problem that the longitudinal size of the movable piece 17 increases, and therefore the size of the whole apparatus increases. [Patent reference 1] JP,5-114341,A The prior art pressure switch has the two independent movable pieces, must measure the load precisely, and must have the mechanism of adjusting the load. A problem with the prior art pressure switch is therefore that the parts equipped in the movable pieces 16 and 17 are combined intricately and the number of the parts is large, while it is necessary to define a positional relationship among the parts and assemble them precisely.

A further problem is that when the hinge portion 17*c* is made to become deformed once, it does not return to its initial position because the deformation of the hinge portion reaches a plastic deformation zone, and therefore the readjustment of the load becomes difficult.

The present invention is made in order to solve the above-mentioned problems, and it is therefore an object of the present invention to provide a pressure switch which does not need precise positioning of two movable pieces in a process of assembling the pressure switch.

DISCLOSURE OF THE INVENTION

In accordance with the present invention, there is provided a snap action mechanism including: first and second movable members each of which has a free end and a fixed end, the first and second movable members being arranged so that their free ends are opposite to each other; a pair of connecting portions which are arranged on both sides of the first and second movable members, these connecting portions connecting the fixed ends of the first and second movable members with each other, and the first and second movable members and the pair of connecting portions being formed of a single metallic plate; and a compression spring arranged between the free ends of the first and second movable members, for exerting a force on both the free ends.

In accordance with the present invention, there is provided a pressure switch provided with a hollow housing, an external force transmission mechanism for dividing an interior of the housing to form two pressure chambers, and for producing a driving force according to a pressure difference between the two pressure chambers, two gas introducing holes which are formed to penetrate the housing so that they correspond to the two pressure chambers, respectively, a snap action mechanism which works in response to the driving force from the above-mentioned external force transmission mechanism, an electric contact which is opened or closed by the snap action mechanism, and a conductive member which transmits the opening or closing of the contact to outside the housing, characterized in that the above-mentioned snap action mechanism is a snap action mechanism according to claim 1.

The pressure switch in accordance with the present invention is characterized in that in addition to the above-mentioned features, the pressure switch includes a load adjustment mechanism for displacing the first movable member, and the above-mentioned load adjustment mechanism causes an elastic deformation portion of the above-mentioned first movable member to become deformed and exerts a reaction force against the above-mentioned external force on the above-mentioned elastic deformation portion.

The pressure switch in accordance with the present invention is characterized in that the pressure switch includes a base plate for supporting the snap action mechanism, and the above-mentioned base plate is fixed to the above-mentioned housing.

The pressure switch in accordance with the present invention is characterized in that the position of a supporting point of the load adjustment mechanism at a time when the elastic deformation portion of the first movable member becomes deformed is fixed.

The pressure switch in accordance with the present invention is characterized in that the housing has an opening for allowing an adjustment from outside the pressure switch of the above-mentioned load adjustment mechanism, and a sealing member is fixed to the above-mentioned opening.

Because the snap action mechanism and the pressure switch in accordance with the present invention uses a main plate 5 in which the two movable members are integrally formed, the present embodiment offers an advantage of being able to always fix the relative positional relationship between the movable members, thereby eliminating variations in the assembly of the pressure switch.

Furthermore, because the component count can be reduced, the present invention offers another advantage of being able to reduce the component cost and to facilitate the assembly of the pressure switch.

The present invention offers a further advantage of being able to perform a load adjustment again because a hinge portion does not become deformed plastically.

In addition, because the base plate for supporting the snap action mechanism is attached to the housing, deformation of the snap action mechanism which is caused by thermal expansion or contraction of the housing can be prevented.

Furthermore, because the position of the supporting point of the load adjustment mechanism at the time when the first movable member becomes deformed is determined exactly, a load which is set up by the amount of bending of the hinge portion can be stabilized.

In addition, because the sealing member is fixed to the opening formed in the housing, leakages from the opening can be prevented.

PREFERRED EMBODIMENTS OF THE INVENTION

Hereafter, in order to explain this invention in greater detail, the preferred embodiments of the present invention will be described with reference to the accompanying drawings.

Embodiment 1

Figure 1:
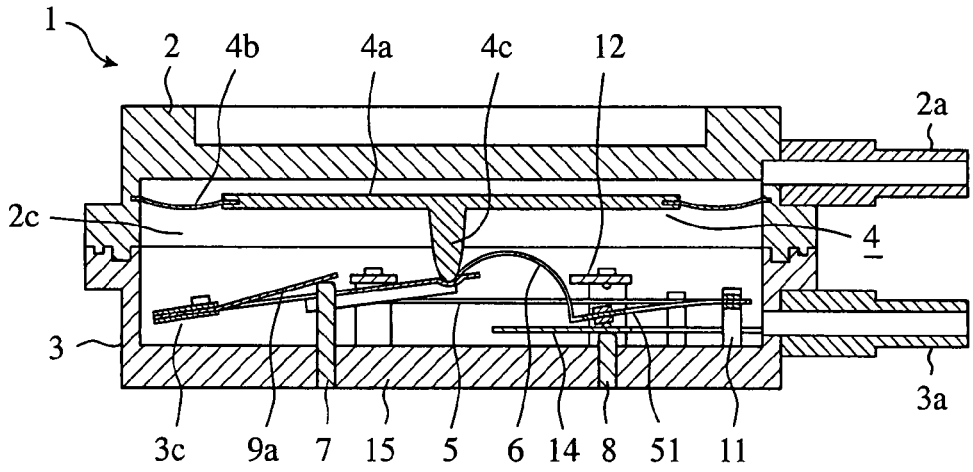
FIG. 1 is a longitudinal sectional view of a pressure switch in accordance with embodiment 1 of the present invention (taken along a dashed dotted line of FIG. 2)
Figure 2:
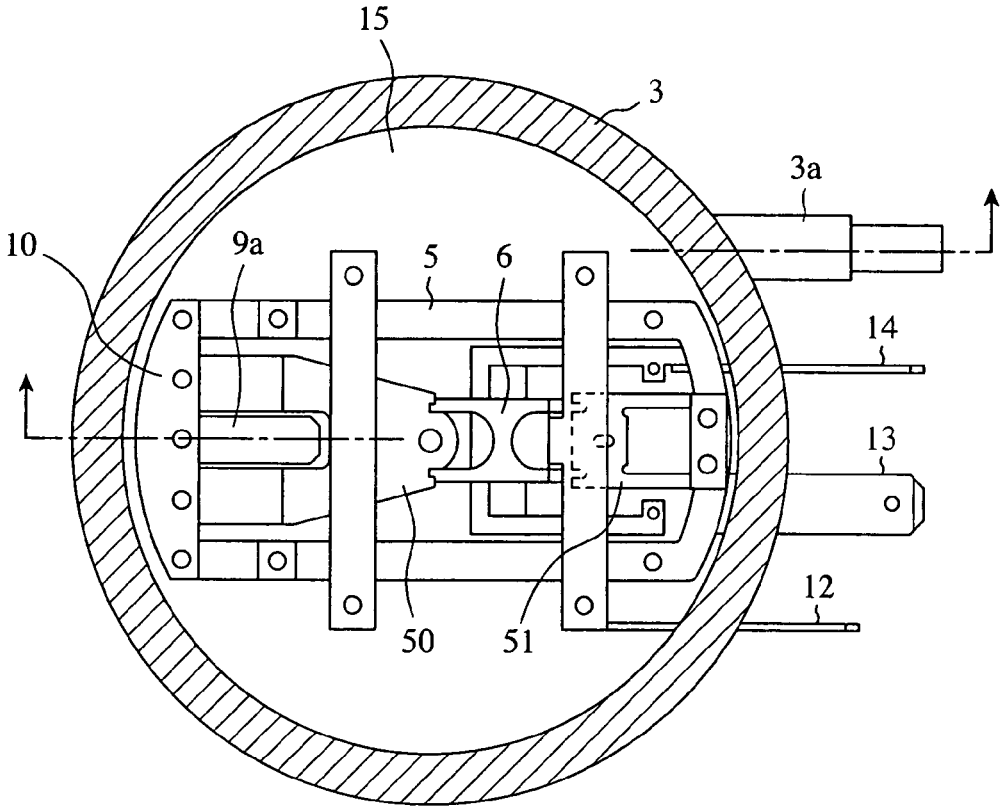
FIG. 2 is a transverse sectional view of the pressure switch in accordance with embodiment 1 of the present invention (a view of a side of a low pressure chamber 3*c*)

Hereafter, embodiment 1 of the present invention will be explained. FIG. 1 is a longitudinal sectional view of a pressure switch in accordance with embodiment 1. FIG. 2 is a transverse sectional view of the pressure switch in accordance with embodiment 1 (a view of a side of a low pressure chamber 3*c*). FIG. 1 shows a cross-sectional view taken along a dashed dotted line of FIG. 2 when viewed along a direction shown by arrows.

In FIGS. 1 and 2, the pressure switch 1 is provided with an upper cover 2 and a lower housing 3, a high-pressure-side pipe port 2*a* is connected to the cover 2, and a low-pressure-side pipe port 3*a* is connected to the housing 3. The high-pressure-side pipe port 2*a* is connected to a high-pressure side of an exhaust pipe of hot water supply equipment, and the low-pressure-side pipe port 3*a* is connected to a low-pressure side of the exhaust pipe (not shown). The connecting position where the high-pressure-side pipe port 2*a* is connected to the cover and the connecting position where the low-pressure-side pipe port 3*a* is connected to the housing are not limited to the examples shown in FIGS. 1 and 2, and they can be connected to arbitrary positions of the cover 2 and the housing 3, respectively.

Each of the cover 2 and the housing 3 is made from a synthetic resin, and they are molded so that their outward appearance has a hollow cylindrical shape having a bottom. Because the cover 2 and the housing 3 are separated by a diaphragm 4 having confidentiality, a chamber surrounded by the housing 2 and the diaphragm 4 serves as a high pressure chamber 2*c* and a chamber surrounded by the housing 3 and the diaphragm 4 serves as a low pressure chamber 3*c*. These high pressure chamber 2*c* and low pressure chamber 3*c* are formed so that they have confidentiality except for the high-pressure-side pipe port 2*a* and the low-pressure-side pipe port 3*a* each of which serves as a gas introducing hole communicating with outside the pressure switch. When the pressure switch is put to common use, the high-pressure-side pipe port 2*a* is connected to a duct through which a gas which is a target for detection is flowing, and the interior of the high pressure chamber 2*c* has a pressure which is the same as the pressure of the gas for detection. The low-pressure-side pipe port 3*a* is open to the air, and the interior of the low pressure chamber 3*c* has the atmospheric pressure. The diaphragm 4 is so formed that a film 4*b* made from a resin projects from a peripheral portion of a center plate 4*a*.

A plunger 4*c* is attached to a central part of the center plate 4*a* so that the plunger project toward the low pressure chamber 3*c*. In the high pressure chamber 2*c*, the film 4*b* becomes deformed elastically toward the low pressure chamber 3*c* according to a pressure exerted on the diaphragm 4 (i.e., the pressure difference between the gas pressure and the atmospheric pressure). With this elastic deformation, the center plate 4*a* and the plunger 4*c* also move downwardly, the plunger 4*c* transmits, as an external force, the above-mentioned pressure to a main plate 5. The diaphragm 4 containing the plunger 4*c* constructs an external force transmission mechanism.

A metallic NC (Normally Close) terminal 14 is fixed to a base 15 of the housing 3 with a leading end portion thereof projecting toward outside the housing 3. A plurality of pillars 11 for supporting the main plate 5 stand on the base 15.

A COM (Common) terminal 13 is arranged on the pillars 11. The main plate 5 is fixed to upper ends of the pillars 11 and is arranged so that the main plate is located above the NC terminal 14 and the COM terminal 13. One end of the metallic COM terminal 13 is connected to an end 5*d* of the main plate 5 so that they are electrically connected to each other, and another end of the metallic COM terminal projects toward outside the housing 3.

The metallic NO (Normally Open) terminal 12 is arranged above the main plate 5, and is fixed to the housing 3 so that its leading end portion projects toward outside the housing 3. The end portions of the terminals 12, 13, and 14 which project toward outside the housing 3 function as connecting terminals for electric connection with external equipment. A snap action mechanism containing the main plate 5 and the flat spring 6 will be mentioned later.

Figure 3:
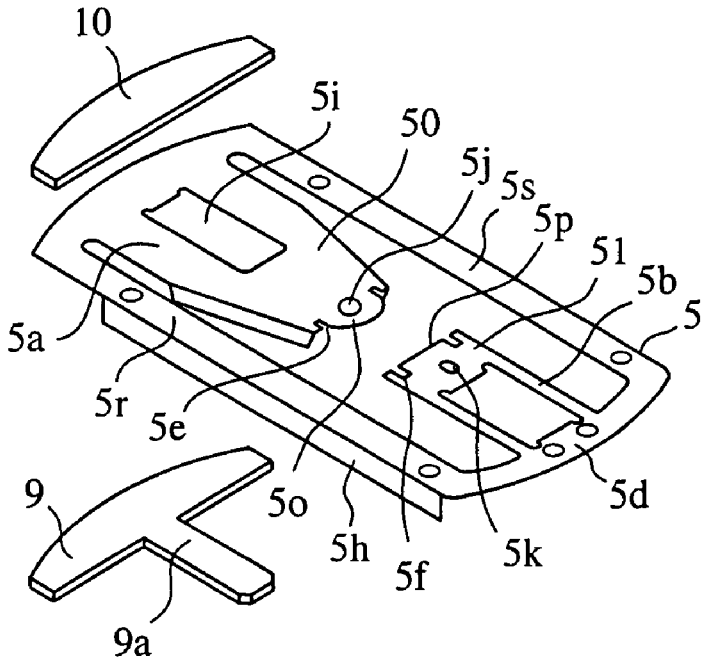
FIG. 3 is a view showing a state in which a load adjustment plate 9 and a load adjustment end plate 10 are attached to a main plate 5 which constructs the pressure switch shown in FIGS. 1 and 2.
Figure 3:
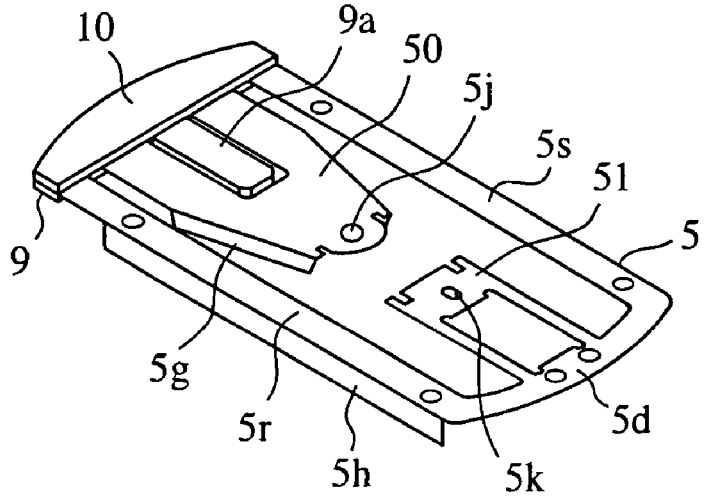

FIG. 3 is a view showing a state in which a load adjustment plate 9 and a load adjustment end plate 10 are attached to the main plate 5 which constructs the pressure switch shown in FIGS. 1 and 2. FIG. 3(*a*) is a top plan view showing the state, and FIG. 3(*b*) is an exploded perspective view showing the state.

To a lower side of an end portion 5*c* of the main plate which is formed by punching a single metal plate, the load adjustment plate 9 having an end portion with the same shape as the end portion 5*c* is fixed so that the end portion 5*c* of the main plate 5 is reinforced. The load adjustment end plate 10 with the same shape as the end portion 5*c* is also fixed to an upper side of the end portion 5*c* so that the end portion 5*c* of the main plate 5 is reinforced.

A load adjusting lever 9*a* of the load adjustment plate 9 is so located as to fit in a long hole portion 5*i* which is drilled in the main plate 5 on the side of the end portion 5*c* along a central axis of the main plate 5.

The main plate 5 is provided with two movable members 50 and 51 which are running along the central axis of the main plate so that they are opposite to each other on the center line. The main plate is provided with elastic deformation portions 5*a* and 5*b* between the movable member 50 and the end portion 5*c*, and between the movable member 51 and the end portion 5*d*, respectively.

The movable member 50 is provided with bent portions 5*g* at isosceles triangle sides thereof. Because the movable member 50 is reinforced by the bent portions 5*g*, the movable member 50 functions almost like a rigid body with respect to the elastic deformation portion 5*a* on which no bending reinforcement is performed. A dented plunger holding portion 5*j* with which a leading end portion of the plunger 4*c* is brought into contact is formed in the leading end portion of the movable member 50.

Because the movable member 51 is a portion which is shaped approximately like a rectangle and is located so as to forwardly project from the leading end portion of the elastic deformation portion 5*b*, and has large rigidity as compared with the elastic deformation portion 5*b* which is so shaped as to bend easily, the movable member 51 functions almost like a rigid body. The movable member 51 is provided with a contact 5*q* on an upper surface thereof and a contact 5*k* on a lower surface thereof.

The main plate 5 is provided bent portions 5*h* at both side surfaces thereof extending in a direction of the length thereof, and functions almost like a rigid body.

As can be seen from the above description, each of the movable members 50 and 51 can be handled as a "cantilever" from a viewpoint of strength of materials. In the movable member 50, a side with a projecting portion 5*o* corresponds to a free end, and a side with the end portion 5*c* corresponds to a fixed end. In the movable member 51, a side with the projecting portion 5*p* corresponds to a free end, and a side with the end portion 5*d* corresponds to a fixed end. The movable members 50 and 51 are arranged so that their free ends are close to each other and opposite to each other. On the other hand, the movable members 50 and 51 are also arranged so that their fixed ends are apart from each other. A pair of connecting portions 5*r* and 5*s* are arranged on the both sides of the movable members 50 and 51, and connect the fixed end of the movable member 50 with the fixed end of the movable member 51. In accordance with this embodiment, both ends of the connecting portion 5*r* and both ends of the connecting portion 5*s* are continuously connected with each other at the end portions 5*c* and 5*d* of the main plate so that the connecting portions are shaped like a frame which encloses the movable members 50 and 51.

Figure 4:
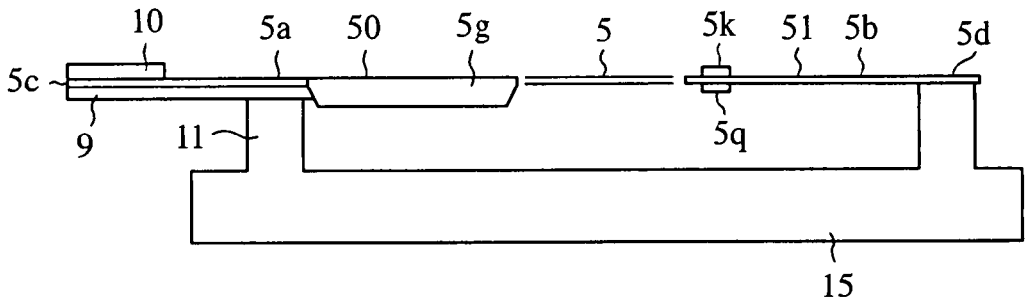
FIG. 4 is a view showing a state in which elastic deformation portions of the main plate 5 of FIG. 3 become deformed.
Figure 4:
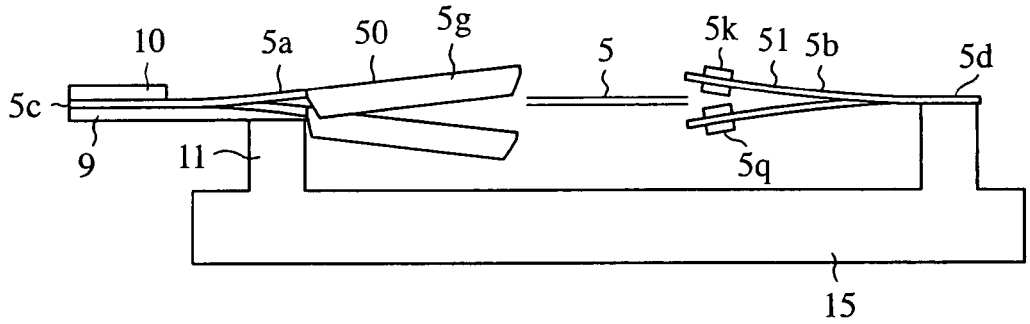

FIG. 4 is a view showing a state in which the elastic deformation portions 5*a* and 5*b* of the main plate 5 of FIG. 3 become deformed. FIG. 4(*a*) shows a state in which they are located at their neutral positions, and FIG. 4(*b*) shows a state in which each of them becomes deformed in an upward or downward direction. In FIG. 4, the movable members 50 and 51 are placed in a state which they are not connected to each other via a flat spring 6. In order to make it easier to understand the state, the bent portions 5*h* of the main plate 5 are not shown in the figure.

As shown in FIG. 4, each of the elastic deformation portions 5*a* and 5*b* can be made to become deformed elastically in an upward or downward direction. Each of the movable members 50 and 51 functions almost like a rigid body.

Figure 5:
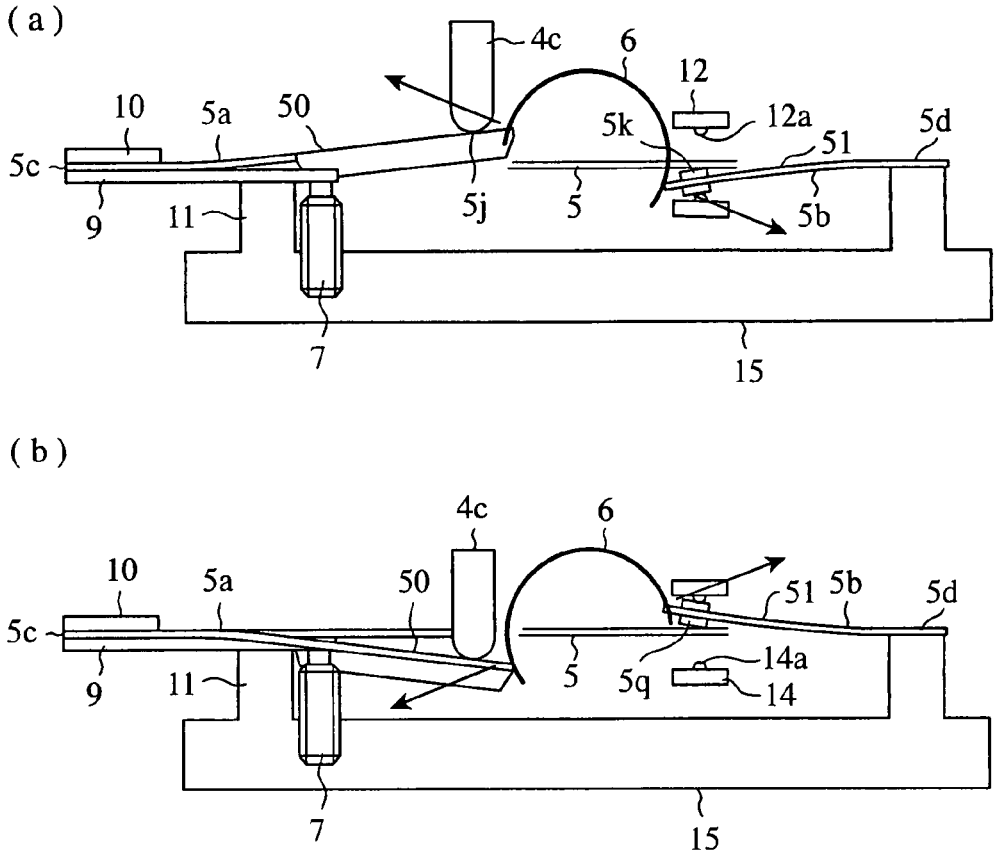
FIG. 5 is a view showing the operation of the pressure switch shown in FIGS. 1 and 2.

Next, the operation of the pressure switch will be explained with reference to FIGS. 1, 2, 3 and 5. FIG. 5 is a view showing the operation of the pressure switch shown in FIGS. 1 and 2, and shows a state in which a setscrew 7 does not exert any force on the load adjusting lever 9*a* at all. FIG. 5(*a*) shows either an initial state or a returned state, and FIG. 5(*b*) shows a state in which the movable members 50 and 51 are reversed because of an external force.

Because the leading end portions (i.e., the free ends) of the movable members 50 and 51 are connected to each other via the flat spring 6, a repulsive force (designated by arrows shown in FIG. 5) is exerted between the both leading end portions. In the initial state, i.e., in a state in which no pressure difference occurs between the high pressure chamber 2*c* and the low pressure chamber 3*c*, the movable member 50 is brought into contact with the leading end of the upper plunger 4*c* because of the repulsive force, and the repulsive force on the other side is exerted downwardly on the movable member 51, as shown in FIG. 5(*a*). Therefore, the contact 5*q* on the lower surface of the movable member 51 is brought into contact with the contact 14*a* on the lower NC terminal 14.

When, in the state of FIG. 5(*a*), the gas pressure of the high pressure chamber 2*c* increases and an external force is exerted on the plunger holding portion 5*j* of the movable member 50 by way of the plunger 4*c*, the elastic deformation portion 5*a* is bent and the movable member 50 is displaced downwardly. When the external force increases and the movable member 50 is further displaced downwardly, a moment which presses the contact 5*q* of the movable member 51 toward the lower contact 14*a* is reversed at the operating point of the movable member 50. As a result, the movable member 51 is displaced upwardly quickly and the contact 5*k* is then brought into contact with a contact 12*a* disposed on the lower surface of the upper NO (Normally Open) terminal 12. FIG. 5(*b*) shows this state, and this series of operations is a reversing operation.

Next, when the gas pressure of the high pressure chamber 2*c* decreases, and therefore the downward external force exerted upon the plunger 4*c* decreases gradually, the bending of the elastic deformation portion 5*a* decreases because of the resilience of the elastic deformation portion 5*a*, and therefore the movable member 50 is displaced upwardly (i.e., starts returning to its original position). When the movable member is displaced to a certain point, the moment which presses the contact 5*k* of the movable member 51 toward the upper contact 12*a* is reversed. As a result, the movable member 51 is displaced downwardly quickly and therefore the contact 5*q* is brought into contact with the lower contact 14*a* again. Therefore, the pressure switch returns to the state as shown in FIG. 5(*a*) (i.e., the returned state). This series of operations is a returning operation. A relation between the downward external force (load) exerted on the plunger 4*c*, and the reversing and returning operations has hysteresis. That is, in FIG. 5, the external force F1 in the case that the snap action mechanism performs the reversing operation, and the external force F2 in the case that the snap action mechanism performs the returning operation have the following relation: F1>F2.

The operation of the pressure switch 1 is determined by the geometric positions of the movable members 50 and 51 on the basis of the snap action mechanism using the above-mentioned reversing and returning operations.

Figure 6:
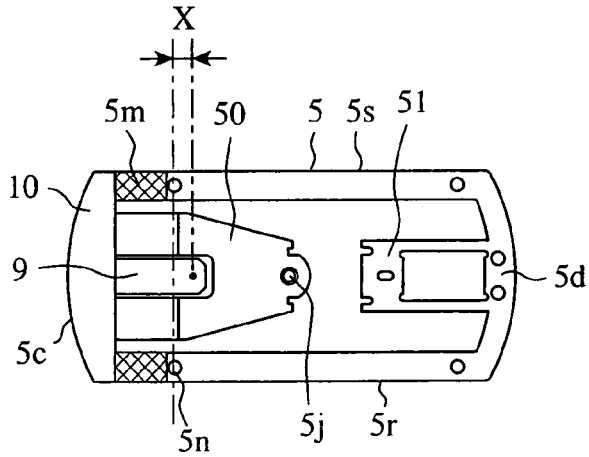
FIG. 6 is a view showing a hinge portion of a movable piece of FIG. 3.
Figure 7:
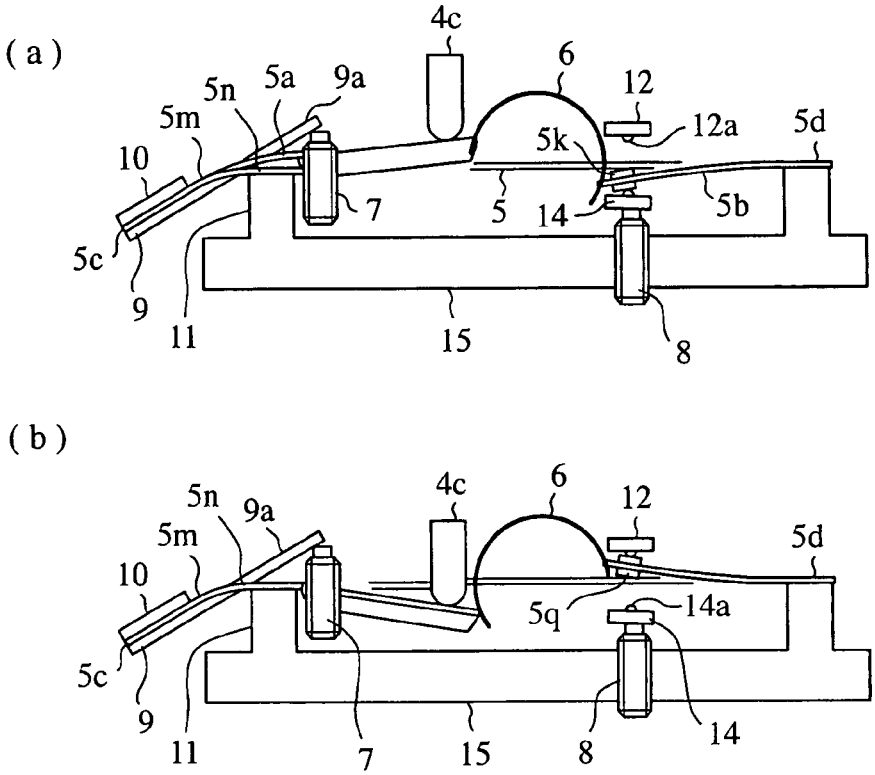
FIG. 7 is a view showing a load adjustment mechanism of the pressure switch shown in FIGS. 1 and 2.

FIG. 6 is a view showing hinge portions 5*m* of the main plate 5 of FIG. 3. In each of the connecting portions 5*r* and 5*s* of the main plate 5, a portion (i.e., a hatched portion in the view) extending between the load adjustment end plate 10 and a fixing portion 5*n* works as a hinge portion 5*m*. Each hinge portion 5*m* is so formed as to have a longitudinal length which is much the same as the length of the elastic deformation portion 5*a*, or which does not differ from the length of the elastic deformation portion 5*a* to an extreme. FIG. 7 is a view showing a load adjustment mechanism of the pressure switch shown in FIGS. 1 and 2. FIG. 7(*a*) shows either an initial state or a returned state of the load adjustment mechanism, and FIG. 7(*b*) shows a reversed state of the load adjustment mechanism.

In the base 15, the setscrew 7 is placed opposite to the load adjusting lever 9*a* of the load adjustment plate 9 so as to penetrate the base 15. A setscrew 8 is similarly arranged opposite to the NC terminal 14. Each of the setscrews 7 and 8 can be moved upwardly or downwardly.

In a case in which setscrews with a hexagon socket head are used as the setscrews 7 and 8, alignment of the setscrews can be easily carried out using a hexagonal wrench.

The position where the setscrew 7 is brought into contact with the load adjustment plate 9 has a slight displacement x in the direction of the plunger holding portion 5*j* with respect to an imaginary line connecting the both fixing portions 5*n*. Because the load adjustment plate 9 is formed of a plate material thicker than the hinge portions 5*m* and therefore has a larger mechanical strength than the hinge portions 5*m*, the load adjustment plate 9 moves integrally as a rigid body when the load adjusting lever 9*a* is pushed up by the setscrew 7, the hinge portions 5*m* extending between the fixing portions 5*n* and the end portion 5*c* are bent with the fixing portions 5*n* for fixing the main plate 5 to the pillars 11 serving as supporting points (refer to FIG. 6). As a result, the elastic deformation portion 5*a* of the main plate 5 also has a certain amount of bending. At this time, the amount of bending of each of the hinge portions 5*m* and the amount of bending of the elastic deformation portion 5*a* are not different from each other so much. This bending results in increase in the reaction force of the elastic deformation portion 5*a* as compared with that in the initial state. That is, a bias B is added to the reaction force. Therefore, even if the movable member 50 is displaced by the same amount of displacement, the above-mentioned reaction force has a balance with a larger external force than that in the case in which the elastic deformation portion does not any bending at all (no bias B is added). By using this principle, the load for reversing the main plate 5 can be adjusted to a desired value. That is, the load (ON point) for causing the pressure switch to perform the reversing operation can be adjusted to F1+B, and the load (OFF point) for causing the pressure switch to perform the returning operation can be adjusted to F2+B.

A distance adjustment mechanism for adjusting the distance between the contacts of the NC terminal 14 and the NO terminal 12 will be explained hereafter. In FIG. 7, the NC terminal 14 is a metallic plate which is shaped like a band having a longitudinal direction which is running in a direction vertical to the figure, and has a certain spring property. Therefore, when the position of the leading end of the setscrew 8 in contact with the lower surface of the NC terminal 14 is adjusted, the position of the NC terminal 14 is changed with the adjustment and the load F1 at the ON point is changed to F1'. As a result, the difference (differential) between the ON point and the OFF point can be adjusted.

A method of adjusting the pressure switch 1 in accordance with embodiment 1 will be explained. As explained above, the pressure switch 1 is provided with the load adjustment mechanism and the distance adjustment mechanism for adjusting the distance between the contacts.

First, the position of the NO terminal 12 (i.e., the contact 12*a*) is fixed at the time when the pressure switch 1 is assembled.

Next, the OFF point is decided by adjusting the strength of the movable member 51 by using the load adjustment mechanism. The OFF point is set to F2+B at this time, while the ON point is also set to F1+B along with this.

Finally, by moving the contact 14*a* by using the distance adjustment mechanism for adjusting the distance between the contacts, the distance between the contact 14*a* and the contact 12*a* is determined and hence the ON point (F1'+B) is decided. For example, assuming that the ON point in the initial state is set to F1=50 Pa and the OFF point in the initial state is set to F2=40 Pa, the ON point becomes F1+B=60 Pa and the OFF point becomes F2+B=50 Pa when the pressure is increased by B=10 Pa by using the load adjustment mechanism.

When the differential is changed from 10 Pa to 8 Pa, the NC terminal 14 (i.e., the contact 14*a*) is moved upwardly by using the distance adjustment mechanism for adjusting the distance between the contacts. As a result, the ON point changes from F1+B=60 Pa to F1'+B=58 Pa, while the differential becomes F1'−F2=8 Pa because the OFF point is still F2+B=50 Pa.

Figure 8:
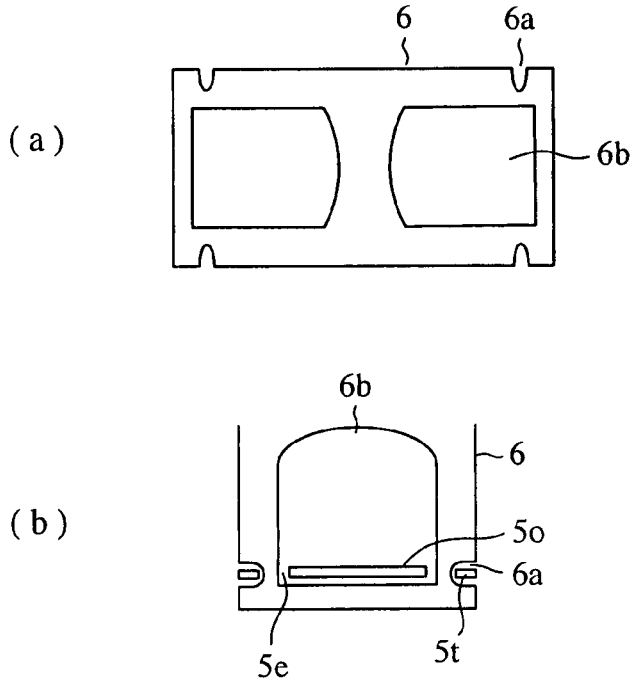
FIG. 8 is a view showing an engaging mechanism for engaging a flat spring with movable pieces, the flat spring and the movable pieces constructing the pressure switch shown in FIGS. 1 and 2.

FIG. 8 is a view showing an engaging mechanism for engaging the flat spring with the movable pieces, the flat spring and the movable pieces constructing the pressure switch shown in FIGS. 1 and 2. FIG. 8(*a*) is a top plan view of the flat spring 6, and FIG. 8(*b*) is an enlarged view of engaging portions for engaging the flat spring 6 with the main plate 5.

Notched portions 5*e* are formed in the both sides of the semicircular projecting portion 5*o* projecting from the center of the leading end portion of the movable member 50. Notched portions 5*f* are formed also in the both sides of the rectangular projecting portion 5*p* projecting from the center of the leading end portion of the movable member 51 (refer to FIG. 3). Notched portions 6*a* are similarly formed in the both sides of the both ends of the flat spring 6. A pair of openings 6*b* are formed on opposite sides of a central part of the flat spring 6. These openings 6*b* are formed in order to adjust the spring property (i.e., the resilience) of the flat spring 6.

In FIG. 8(*b*), the projecting portion 5*o* of the movable member 50 is inserted into an opening 6*b* of the flat spring 6, and the notched portions 5*e* of the movable member 50 are engaged with corresponding notched portions 6*a* of the flat spring 6 so that movements in a rightward or leftward direction in the figure of the notched portions 6*a* of the flat spring 6 are restricted by the projecting portions 5*o* and 5*t* of the movable member 50. Therefore, the flat spring 6 cannot be easily disengaged from the movable member 50. FIG. 8(*b*) shows only the engaging mechanism for engaging the flat spring 6 with the movable member 50, while a similar engaging mechanism is provided for the combination of the flat spring 6 and the movable member 51.

The both ends of the flat spring 6 are respectively engaged with the leading end portions of the movable members 50 and 51, as mentioned above, and the flat spring 6 is bent so that it is shaped like a letter C with respect to the both movable members 50 with its openings being opposite to each other, and acts as a compression spring.

Figure 9:
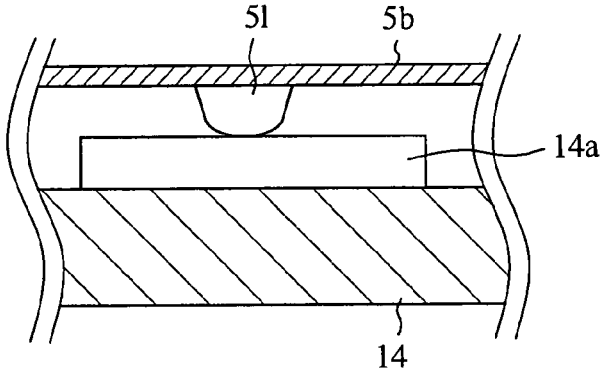
FIG. 9 is a view showing contact between contacts of an NC terminal and a COM terminal which are shown in FIGS. 1 and 2.
Figure 10:
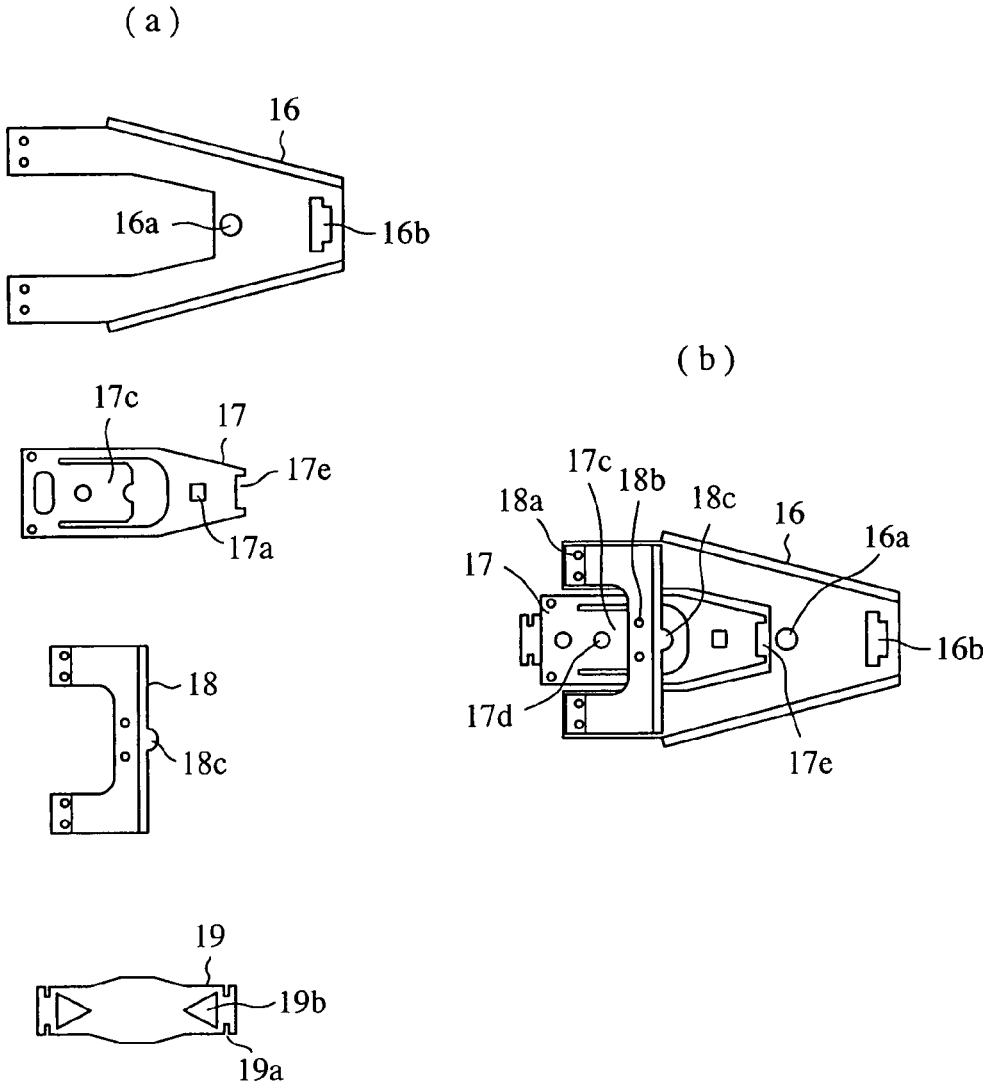
FIG. 10 is a view showing main components of a prior art pressure switch.
Figure 11:
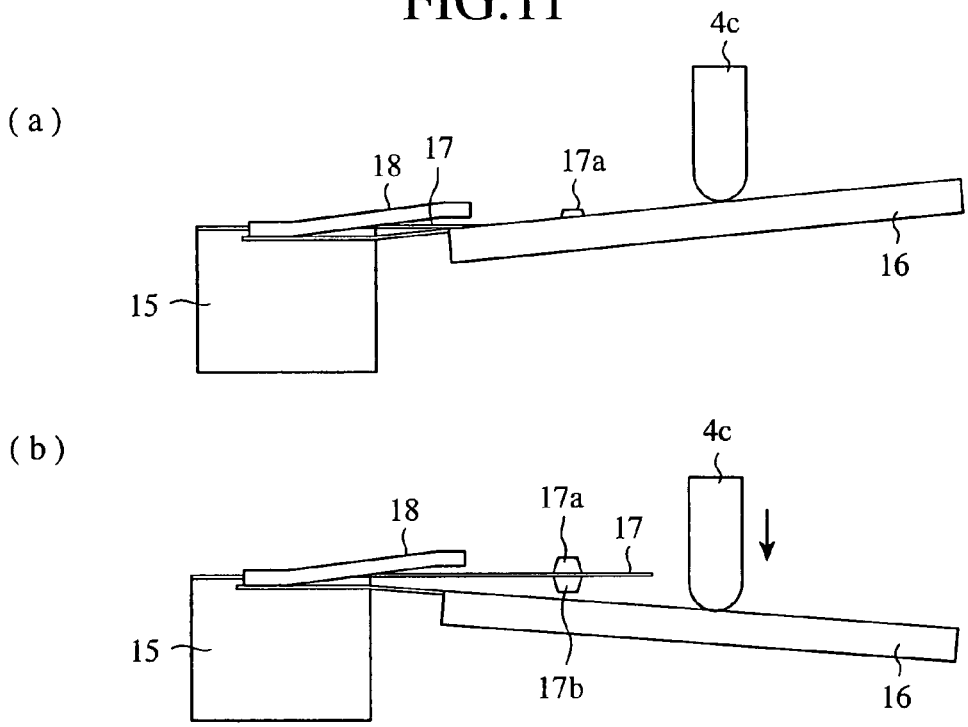
FIG. 11 is a view showing the operation of a movable piece 16 of FIG. 10.
Figure 12:
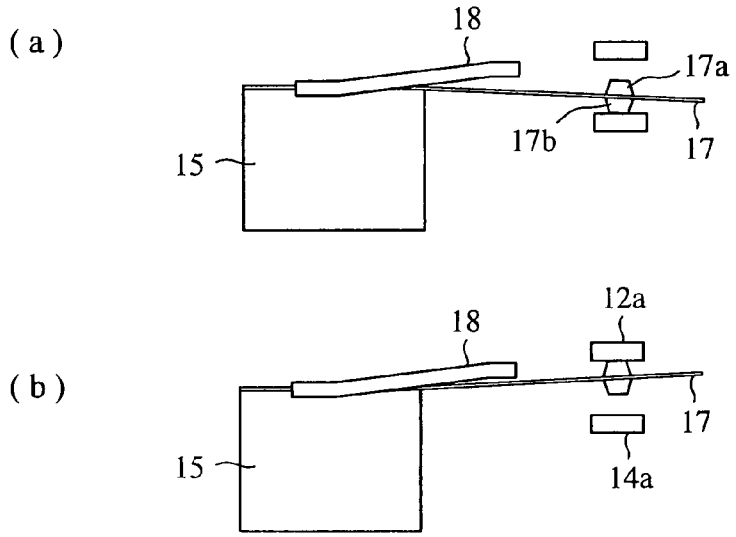
FIG. 12 is a view showing the operation of a movable piece 17 of FIG. 10.
Figure 13:
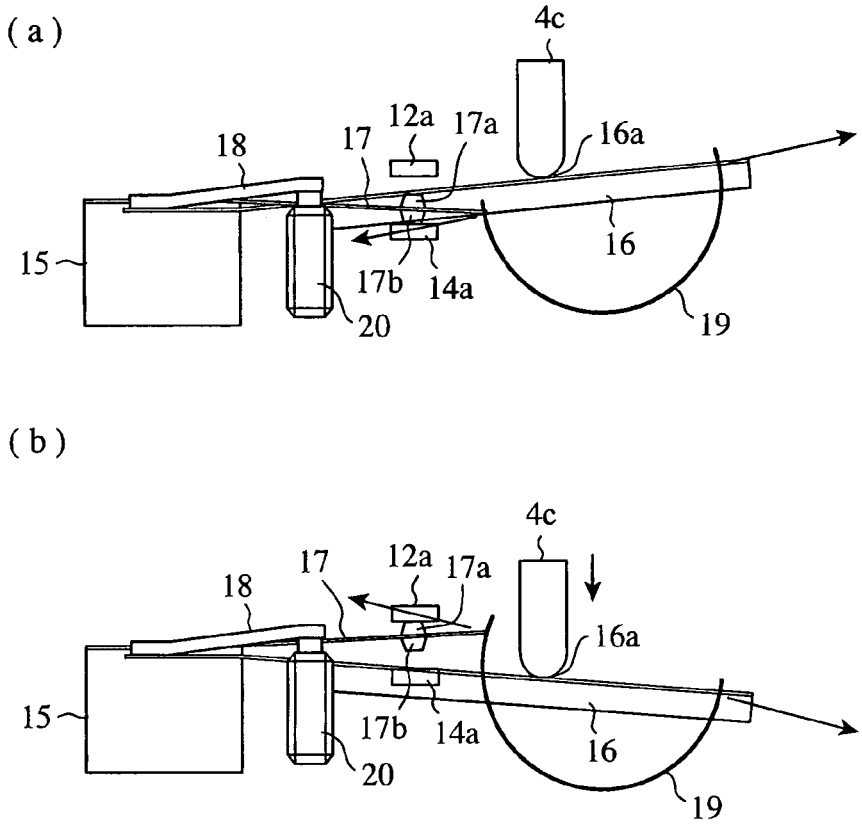
FIG. 13 is a view showing the operation of the prior art pressure switch.
Figure 14:
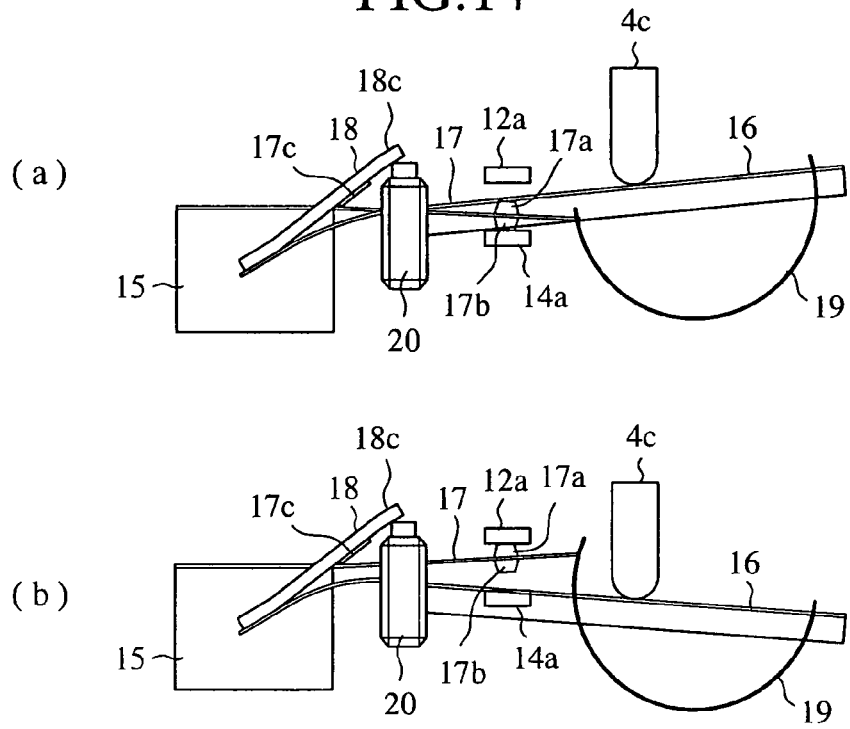
FIG. 14 is a view showing a load adjustment mechanism of the prior art pressure switch.
Figure 15:
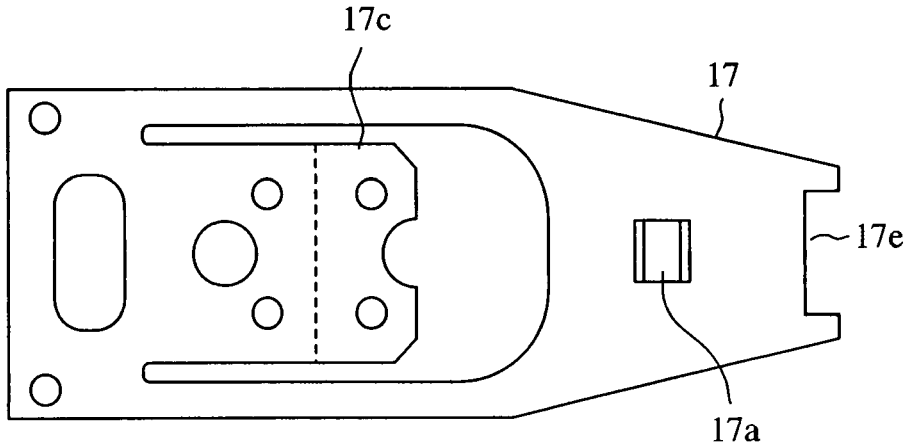
FIG. 15 is a view showing deformation of a hinge portion of the movable piece 17 of FIG. 10.
Figure 15:
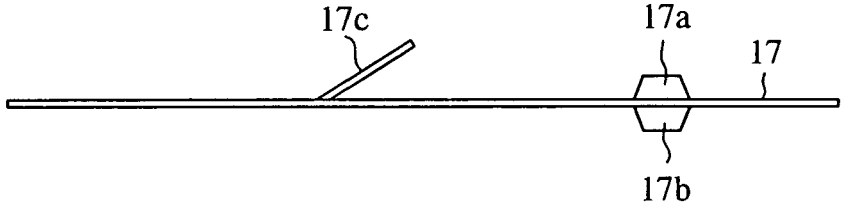

FIG. 9 is a view showing contact between the contacts of the NC terminal 14 and the COM terminal 13 which are shown in FIGS. 1 and 2. Although FIG. 9 shows contact between the contact 14*a* and the contact 5*q*, contact between the contact 12*a* and the contact 5*k* is similarly shown.

The COM terminal 13 is always placed in a state in which it is electrically connected to the main plate 5, as shown in FIG. 1, and the contacts 5*k* and 5*q* disposed on the leading end portion of the movable member 51 of the main plate 5 serve as the contact of the COM terminal 13.

The contacts 5*q* and 14*a* of FIG. 9 are of identical shape with each other, and have an appearance which is shaped like a substantially semicircular cylinder. Therefore, because the contact 5*q* and the contact 14*a* are brought into contact with each other at their arc-shaped top parts opposite to each other by means of a so-called crossbar method, the reliability of the contact between the contacts 5*q* and 14*a* can be improved.

The shape of each of the contacts is not limited to this example and can be shaped like a button or a cylinder.

As mentioned above, the pressure switch according to this embodiment 1 uses the main plate 5 in which the two movable members 50 and 51 are integrally formed. Therefore, the present embodiment offers an advantage of being able to always fix the relative positional relationship between the movable members 50 and 51, thereby eliminating variations in the assembly of the pressure switch.

Furthermore, because the component count can be reduced, the present embodiment offers another advantage of being able to reduce the component cost and to facilitate the assembly of the pressure switch.

In addition, as a derivative advantage, the present embodiment makes it possible to make the length of each of the hinge portions 5*m* close to the length of the elastic deformation portion 5*a*, and hence to make the amount of bending of each of the hinge portions 5*m* at the time of the load adjustment be much the same as the amount of bending of the elastic deformation portion 5*a*. Therefore, the present embodiment can implement a load adjustment mechanism which makes it easy to design the hinge portions 5*m* so that they can hardly become deformed plastically.

In the explanation of the pressure switch in accordance with embodiment 1, technical terms indicating directions with respect to the gravity, e.g., "upward, downward, leftward, and rightward directions" are used for convenience' sake in order to simply explain this embodiment with reference to the drawings. However, because the pressure switch is actually attached to an exhaust pipe which is extending in an arbitrary direction, each component of the pressure switch 1 can take an arbitrary direction (i.e., an arbitrary attitude) with respect to the gravity direction.

Embodiment 2

Hereafter, embodiment 2 of the present invention will be explained. In the pressure switch in accordance with embodiment 1, because the synthetic resin from which the housing 3 is made has a thermal expansion coefficient different from that of the metallic material from which the snap action mechanism containing the main plate 5 is made, there is a possibility that the main plate 5 expands or contracts because of the thermal expansion or contraction of the housing 3, and the load (ON point) which causes the snap action mechanism to perform a reversing operation, and the load (OFF point) (referred to as an operating point from here on) which causes the snap action mechanism to perform a returning operation shift from their originally-preset values.

Furthermore, the pressure switch 1 in accordance with embodiment 1 is so constructed that the hinge portions 5*m* are bent with the fixing portions 5*n* serving as supporting points, though there is a possibility that unless the fixing portions 5*n* serving as supporting points are positioned exactly, the operating point shifts.

In addition, because in the pressure switch 1 in accordance with embodiment 1, the setscrews 7 and 8 are so disposed as to penetrate the base 15 of the housing 3, if a leakage occurs from the penetrating holes which face the exterior of the housing 3, the pressure of the low pressure chamber 3*c* may decrease and a malfunction may occur in the returning operation.

A pressure switch 1 in accordance with embodiment 2 has a structure which solves the above-mentioned problems.

Figure 16:
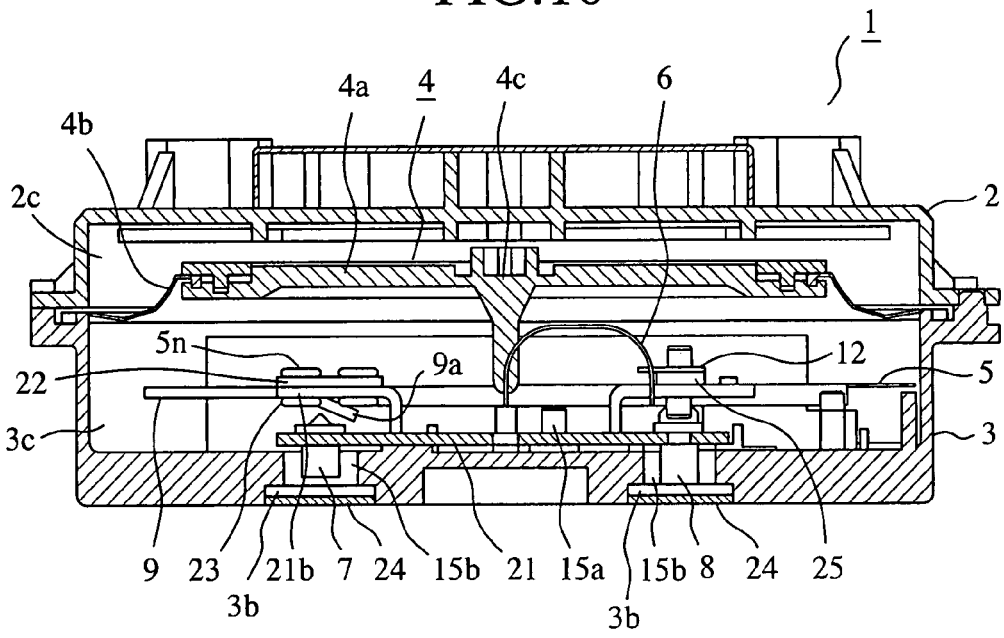
FIG. 16 is a longitudinal sectional view showing the internal structure of a pressure switch in accordance with embodiment 2 of the present invention.
Figure 17:
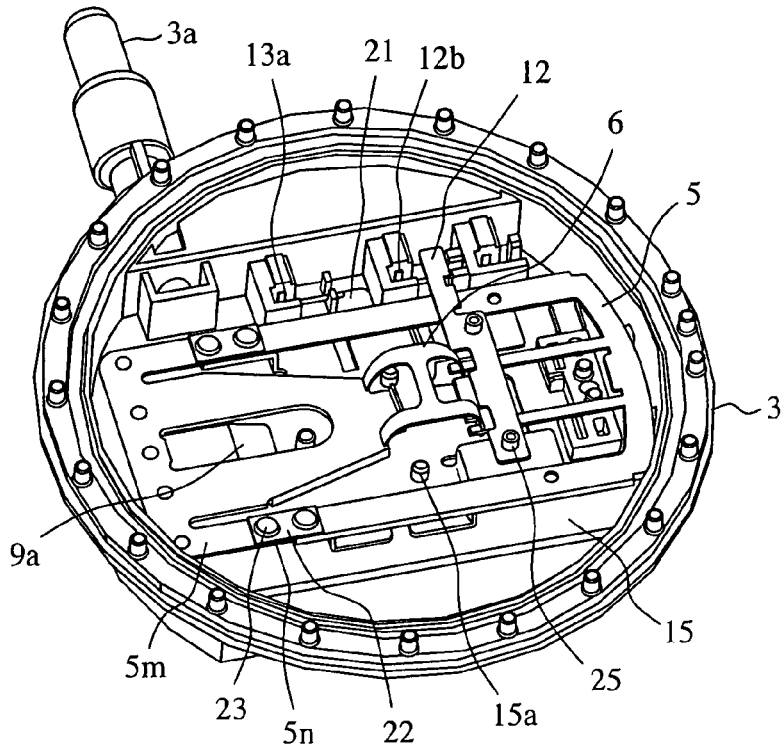
FIG. 17 is a perspective view showing the internal structure of a low pressure chamber's side in which a diaphragm and a cover are removed from the pressure switch of FIG. 16.
Figure 18:
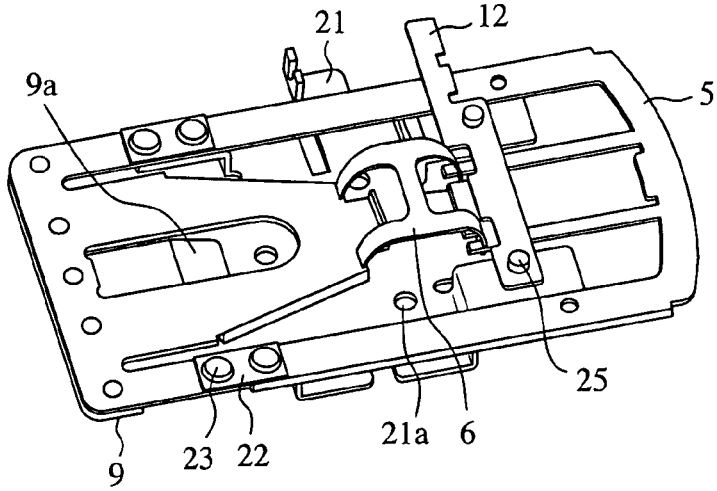
FIG. 18 is a perspective view showing a state in which a housing is removed from FIG. 17.
Figure 19:
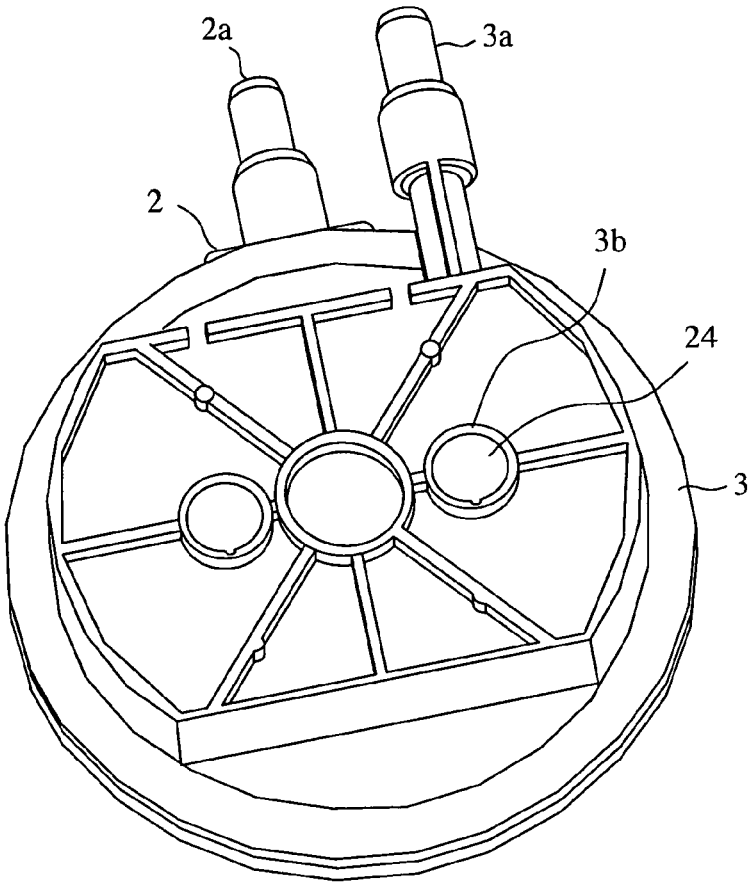
FIG. 19 is a perspective view showing a state in which the pressure switch of FIG. 16 is viewed from a lower part thereof.
Figure 20:
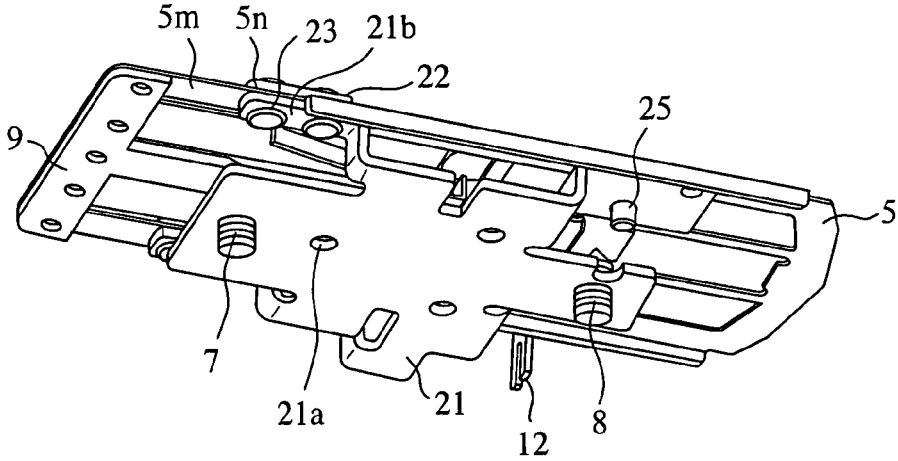
FIG. 20 is a perspective view showing a state in which the housing is removed from FIG. 19 and the pressure switch is viewed from the lower part thereof.
Figure 21:
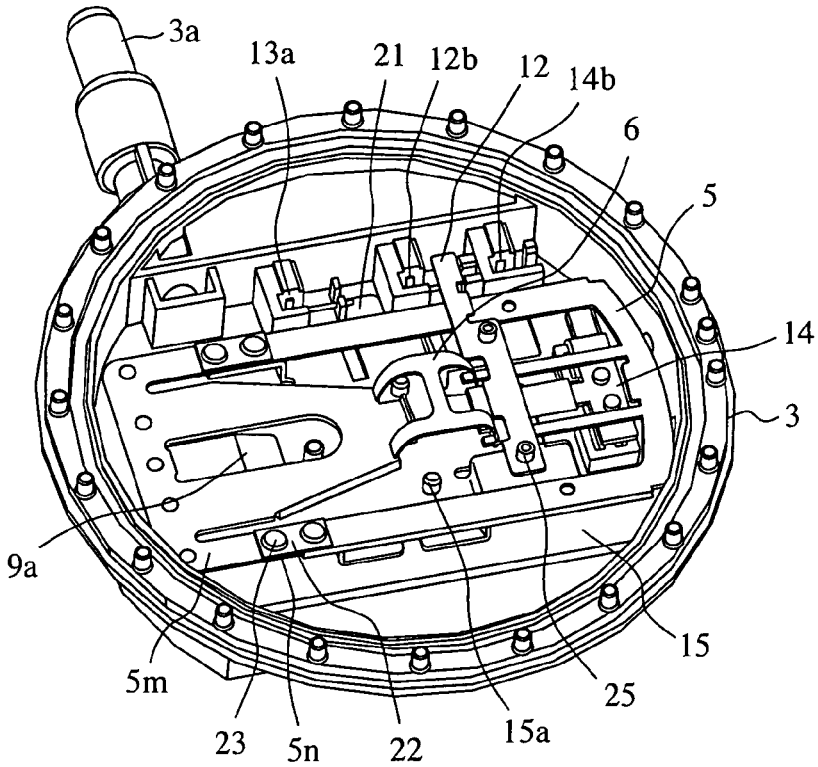
FIG. 21 is a perspective view showing the internal structure of the low pressure chamber's side of the pressure switch having a structure different from that shown in FIG. 17.

FIG. 16 is a longitudinal sectional view showing the internal structure of the pressure switch in accordance with embodiment 2 of the present invention, FIG. 17 is a perspective view showing the internal structure of a low pressure chamber's side in which the diaphragm and the cover are removed from the pressure switch of FIG. 16, FIG. 18 is a perspective view showing a state in which the housing is removed from FIG. 17, FIG. 19 is a perspective view showing a state in which the pressure switch of FIG. 16 is viewed from a lower part thereof, FIG. 20 is a perspective view showing a state in which the housing is removed from FIG. 19 and the pressure switch is viewed from the lower part thereof, and FIG. 21 is a perspective view showing the internal structure of the low pressure chamber's side of the pressure switch having a structure different from that shown in FIG. 17.

Next, the structure of the pressure switch in accordance with embodiment 2 will be explained with reference to FIGS. 16 to 21 by focusing on the difference between embodiment 2 and embodiment 1.

In the pressure switch 1 in accordance with embodiment 1, as shown in FIG. 1, the main plate 5 is supported by the two or more pillars 11 which project from the base 15 of the housing 3.

In contrast, the pressure switch 1 in accordance with embodiment 2 has a structure (floating structure) in which the main components of the snap action mechanism containing the main plate 5 are arranged on a base plate 21, and the base plate 21 is fixed onto the base 15 of the housing 3.

As shown in FIGS. 16 to 18, and 20, the base plate 21 has holes 21*a* which are drilled in a central portion thereof and which are engaged with projecting portions 15*a* which are formed in a central portion of the base 15 of the housing 3. Although the number of the engaging portions (the holes 21*a* or the projecting portions 15*a*) formed in each of the base plate 21 and the base 15 is three, the number can be arbitrary (the base plate can be fixed to the base at a central point of the housing 3 if possible).

By thus fixing the base plate 21 to a narrow central area of the housing 3, the influence of the thermal expansion or contraction of the housing 3 upon the main plate 5 can be reduced as much as possible.

In a case in which the pressure switch 1 is connected to an exhaust side, the base plate 21 may be exposed to a corrosive gas. Furthermore, in order to prevent the influence of the thermal expansion or contraction of the housing 3 upon the snap action mechanism, the base plate 21 has to have a certain degree of strength (i.e., a certain thickness).

Therefore, the base plate 21 is made from a metallic material which is excellent in corrosion resistance and strength, for example, a plate material, such as a brass plate material.

Both end portions of the base plate 21 in a longitudinal direction thereof extend from the height of the bottom of the base plate which is in contact with the base 15 to the height of a flat surface of the main plate 5, and the main plate 5 is supported on the both ends of the base plate.

The fixing portions 5*n* of the main plate 5 are in contact with fixing portions 21*b* each of which is an end portion of the base plate 21, a stiffening plate 22 is further placed onto each of the fixing portions, and the fixing portions are fixed to the fixing portions with rivets 23 (refer to FIG. 20).

By thus fixing the fixing portions 5*n* of the main plate 5 onto the fixing portions 21*b* of the base plate 21, the supporting points for the bending of the hinge portions 5*m* can be determined exactly.

As an alternative, by using a stiffening plate in which one rivet 23 is integral with the stiffening plate 22, a fixing portion 5*n* can be fixed to each fixing portion 21*b* with a remaining rivet 23.

As shown in FIGS. 16, 19 and 20, the setscrews 7 and 8 are screwed into the base plate 21 so that they can move vertically, and an end of each of the setscrews 7 and 8 projecting from the base plate 21 is inserted into a penetrating hole 15*b* of the base 15 of the housing 3.

A cap member 24 is fixed to an opening 3*b* of each penetrating hole 15*b*, the opening facing the exterior of the housing 3.

The cap member 24 is made from an epoxy-glass fabric composite resin which is used as a material for printed circuit boards and so on. The epoxy-glass fabric composite resin is, for example, an epoxy resin in which glass particles or glass fibers are distributed.

Each cap member 24 is a plate which is circularly punched from a plate material, and is fixed to an opening 3*b* of the housing 3 with an epoxy adhesive bond or the like being applied thereto. As a means for bonding each cap member to an opening, plastic welding, such as ultrasonic welding, can be used instead of the adhesive bond.

If each cap member 24 is made from a conductive material, such as a metallic material, a leakage of electricity may flow through the setscrews 7 and 8 from the base plate 21, and then may flow toward outside the pressure switch. Therefore, it is desirable that each cap member 24 is made from a non-conducting material which is excellent in thermal resistance, and has a thermal expansion coefficient which is close to that of the housing 3.

Because each penetrating hole 15*b* has an inside diameter larger than the outer diameter of each of the setscrews 7 and 8, the setscrews 7 and 8 are not in contact with the housing 3.

In the pressure switch 1 in accordance with embodiment 1, one end portion of the COM terminal 13 is coupled to the end portion 5*d* of the main plate 5 so that they are electrically connected to each other, and another end portion of the COM terminal projects toward outside the housing 3.

In contrast with this, in the pressure switch 1 in accordance with embodiment 2, the base plate 21 serves as the COM terminal.

As shown in FIGS. 16 to 18, and 20, one side edge portion of the base plate 21 is connected to a COM external terminal 13*a* inserted into the housing 3. Because the main plate 5 is supported on the base plate 21, the main plate 5 is electrically connected to the COM external terminal 13*a*.

The NO terminal 12 is arranged on another end portion of the base plate 21, which is opposite to the fixing portion 21*b*, via a non-conducting spacer 25, and is connected to a NO external terminal 12*b* inserted into the housing 3. Therefore, the NO terminal 12 and the base plate 21 (i.e., the COM terminal) are electrically independent of each other.

The pressure switch in accordance with the present invention has one of the following switch structures: SPST and SPDT. For example, the pressure switch 1 of FIG. 16 is an SPST (Single Pole Single Throw) switch which does not have the NC terminal 14. In contrast, the pressure switch 1 of FIG. 21 is an SPDT (Single Pole Double Throw) switch which has the NC terminal 14.

The SPDT switch shown in FIG. 21 is placed in a state (a noncontact state) in which the NC terminal 14 is fixed to the base 15 of the housing 3 and is floated from the base plate 21. The NC terminal 14 is connected to the NC external terminal 14*b* inserted into the housing 3.

The setscrew 8 which adjusts the position of the NC terminal 14 penetrates the base 15 of the housing 3 without being screwed into the base plate 21, and is not in contact with the base plate 21.

Therefore, in the case of the SPDT switch, the NC terminal 14 and the base plate 21 (i.e., the COM terminal) are electrically independent of each other.

Because the operation of the pressure switch 1 in accordance with embodiment 2 is the same as that of the pressure switch 1 in accordance with embodiment 1, the explanation of the operation of the pressure switch 1 in accordance with embodiment 2 will be omitted hereafter.

As mentioned above, the pressure switch according to this embodiment 2 can prevent the main plate 5 from becoming deformed because of the thermal expansion or contraction of the housing 3 by attaching the base plate 21 to the housing 3 with the main plate 5 being supported by the base plate 21.

Furthermore, by fixing the fixing portions 5*n* of the main plate 5 to the fixing portions 21*b* of the base plate 21 using the rivets 23 and the stiffening plate 22, the supporting points of the hinge portions 5*m* can be positioned exactly, and the load (i.e., the operating point) which is set up by the amount of bending of the hinge portions 5*m* can be stabilized.

In addition, leakages from the openings 3*b* can be prevented by fixing a cap member 24 which is excellent in thermal resistance to each opening 3*b* of the housing 3.

Furthermore, because the circular cap member 24 can be easily formed by punching it from a plate material, and no metallic mold is needed for forming the circular cap member, the cost of the pressure switch can be reduced.

INDUSTRIAL APPLICABILITY

As mentioned above, because the snap action mechanism and the pressure switch in accordance with the present invention operate according to variations in the pressure of a wind from a fan or the like, they are suitable for, for example, a safety apparatus which checks the pressure of an exhaust gas in an exhaust pipe, and which prevents incomplete combustion from occurring in hot water supply equipment or the like.

The invention claimed is:

1. A snap action mechanism comprising:

first and second movable members each of which has a free end and a fixed end, said first and second movable members being arranged so that their free ends are opposite to each other;

a pair of connecting portions which are arranged on both sides of said first and second movable members, these connecting portions connecting the fixed ends of said first and second movable members with each other, and said first and second movable members and the pair of connecting portions being formed of a single metallic plate; and a compression spring arranged between the free ends of said first and second movable members, for exerting a force on both the free ends.

2. A pressure switch provided with a hollow housing, an external force transmission mechanism for dividing an interior of said housing to form two pressure chambers, and for producing a driving force according to a pressure difference between the two pressure chambers, two gas introducing holes which are formed to penetrate the housing so that they correspond to the two pressure chambers, respectively, a snap action mechanism which works in response to the driving force from said external force transmission mechanism, an electric contact which is opened or closed by said snap action mechanism, and a conductive member which transmits the opening or closing of said contact to outside the housing, characterized in that said snap action mechanism is a snap action mechanism according to claim 1.

3. The pressure switch according to claim 2, characterized in that said pressure switch includes a load adjustment mechanism for displacing the first movable member, and said load adjustment mechanism causes an elastic deformation portion of said first movable member to become deformed and exerts a reaction force against said external force on said elastic deformation portion.

4. The pressure switch according to claim 2, characterized in that said pressure switch includes a base plate for supporting the snap action mechanism, and said base plate is fixed to said housing.

5. The pressure switch according to claim 3, characterized in that a position of a supporting point of the load adjustment mechanism at a time when the elastic deformation portion of the first movable member becomes deformed is fixed.

6. The pressure switch according to claim 3, characterized in that the housing has an opening for allowing an adjustment from outside said pressure switch of said load adjustment mechanism, and a sealing member is fixed to said opening.

* * * * *